United States Patent [19]

Sakamoto et al.

[11] Patent Number: 4,787,351

[45] Date of Patent: Nov. 29, 1988

[54] SYSTEM FOR CONTROLLING IDLE SPEED OF AN ENGINE

[75] Inventors: Masanori Sakamoto, Tokyo; Takuro Morozumi, Mitaka, both of Japan

[73] Assignee: Fuji Jukogyo Kabushiki Kaisha, Tokyo, Japan

[21] Appl. No.: 128,230

[22] Filed: Dec. 3, 1987

[30] Foreign Application Priority Data

Dec. 3, 1986 [JP] Japan ..... 61-289542

[51] Int. Cl.[4] ..... F02D 41/16; F02D 41/08

[52] U.S. Cl. ..... 123/339; 123/588

[58] Field of Search ..... 123/339, 585, 588, 587

[56] References Cited

U.S. PATENT DOCUMENTS

| | | | |
|---|---|---|---|
| 4,522,176 | 6/1985 | Takao et al. | 123/588 X |
| 4,649,877 | 3/1987 | Yasuoka et al. | 123/339 |
| 4,702,210 | 10/1987 | Yasuoka et al. | 123/339 |
| 4,716,871 | 1/1988 | Sakamoto et al. | 123/588 X |
| 4,724,808 | 2/1988 | Kadota | 123/339 |
| 4,745,899 | 5/1988 | Kiuchi et al. | 123/339 |
| 4,748,951 | 6/1988 | Manaka et al. | 123/339 |

FOREIGN PATENT DOCUMENTS 0158343 9/1983 Japan .

*Primary Examiner*—Willis R. Wolfe

*Attorney, Agent, or Firm*—Martin A. Farber

[57] ABSTRACT

An engine has a bypass around a throttle valve and a solenoid operated idle speed control valve provided in the bypass. The control valve is driven by driving pulses duty ratio of which is dependent on a coolant temperature and an old learning correction value. Temperature of a solenoid of the control valve is converted to voltage. A map is provided for storing normal temperature duty ratios, one of which is derived from the map in dependence on duty ratio of the driving pulses and the voltage. Difference between the duty ratio of the driving pulses and the derived normal temperature duty ratio is stored in a memory. When an ignition switch is turned off, the difference is added to the old learning correction value to produce a new learning correction value. The new learning correction value is used for a subsequent engine operation instead of the old learning correction value.

2 Claims, 5 Drawing Sheets

SYSTEM FOR CONTROLLING IDLE SPEED OF AN ENGINE

BACKGROUND OF THE INVENTION

The present invention relates to a system for controlling idle speed of an engine having an idle speed control valve in a bypass around a throttle valve.

The idle speed is controlled by adjusting duty ratio of pulses for driving a solenoid of the idle speed control valve to control air flow passing the bypass. In a conventional idle speed control system (ISC), a driving pulse duty ratio (ISCON) is determined by a basic duty ratio (ISCTW) dependent on the temperature of a coolant of the engine and a feedback correction value (ISCFB) which is a difference between actual idle speed and a desired idle speed dependent on the temperature of the coolant of the engine. Namely, the driving pulse duty ratio ISCON is $$ISCON = ISCTW + ISCFB$$

Further, a learning correction value (ISCALT) is added to the duty ratio ISCON in order to stabilize the idle speed.

Japanese Patent Laid Open No. 58-158343 discloses a learning control system for idle speed. In the system, a learning value used for determining the idle speed is stored in a memory when an engine is stopped. When the engine is re-started, the stored learning value is used for the idle speed. At the stop of the engine, the solenoid of the idle speed control valve has a high temperature, because of high temperature of the engine. At high temperature, the solenoid has a larger resistance compared with that of cold engine operating conditions. Accordingly, the duty ratio should be set to a larger value than the cold engine in order to compensate the larger resistance. Therefore, if the learning value stored at the last operation of the engine is used at the re-start of the engine, the value is too large to control the idle speed at cold engine operation, causing increase of engine speed after the engine starts.

SUMMARY OF THE INVENTION

The object of the present invention is to provide an idle speed control system which may correct the deviation of the duty ratio of driving pulses at the re-start of the engine to stabilize the idle speed of the engine.

According to the present invention, there is provided a system for controlling idle speed of an engine having a bypass around a throttle valve and a solenoid operated idle speed control valve provided in the bypass.

The system comprises first means for generating driving pulses for driving the idle speed control valve in dependence on a coolant temperature and an old learning correction value, second means for converting temperature of a solenoid of the control valve to voltage, a map storing normal temperature duty ratios, third means for driving a normal temperature duty ratio from the map in dependence on duty ratio of the driving pulses and the voltage, a first calculator for producing a difference between the duty ratio of the driving pulses and the derived normal temperature duty ratio, a memory storing the difference as a correction value, detecting means for detecting turning off of an ignition switch and for producing an off signal, a second calculator responsive to the off signal for adding the correction value to the old learning correction value to produce a new learning correction value and for storing the new learning correction value for a subsequent engine operation instead of the old learning correction value.

In an aspect of the invention, fourth means is provided for producing a feedback correction signal from a difference between an actual idle speed and a desired idle speed, and the feedback correction signal is added to the correction value to produce a final correction value which is used for producing a new learning correction value.

The other objects and features of this invention will be apparently understood from the following description with reference to the accompanying drawings.

DETAILED DESCRIPTION OF THE PREFERRED EMBODIMENT

Figure 1:
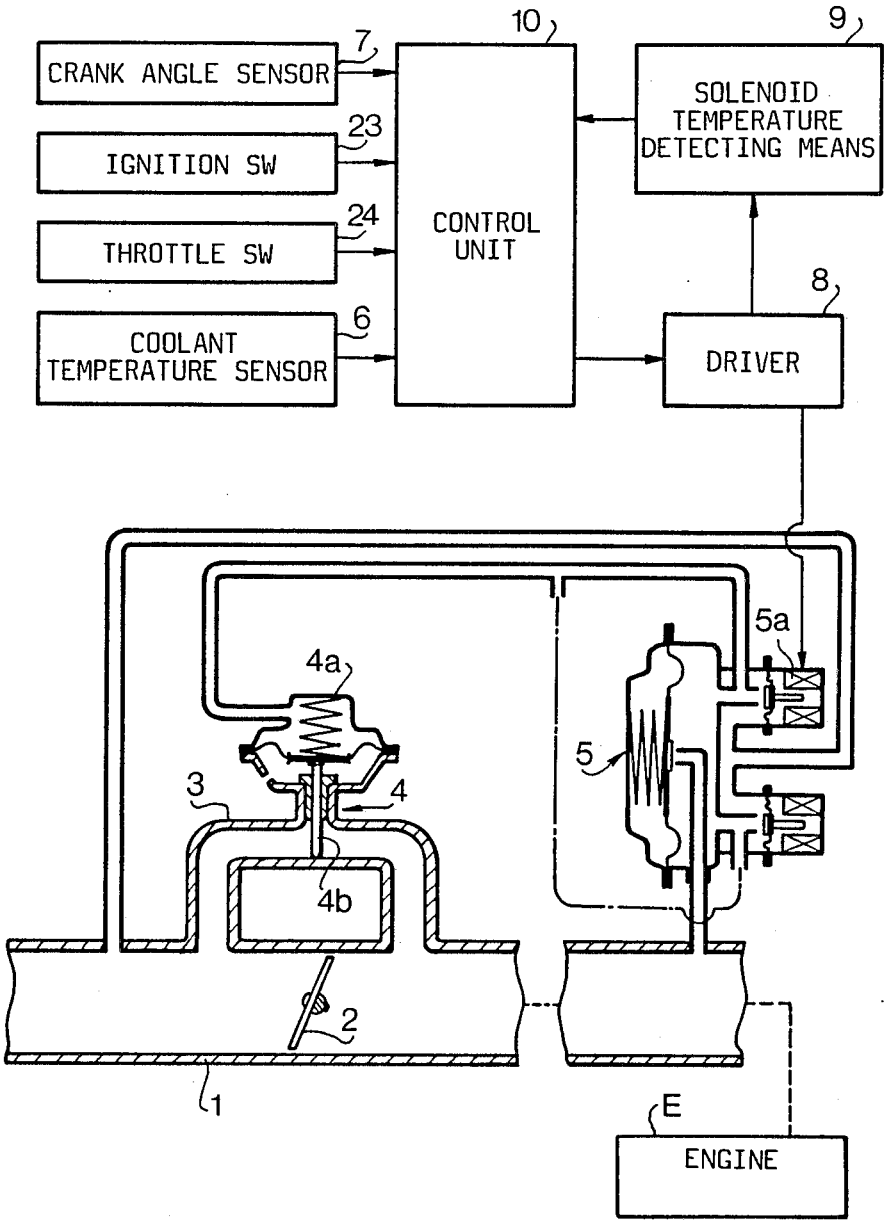
FIG. 1 is a schematic illustration showing a system for controlling idle speed of an internal combustion engine for a motor vehicle.

Referring to FIG. 1, an internal combustion engine E for a motor vehicle is supplied with air through an intake passage 1 and a throttle valve 2, mixing with fuel injected from an injector (not shown).

An idle speed control valve 4 comprising a valve plate **4*b* is provided in a bypass 3 around the throttle valve 2. The control valve 4 is operated by a vacuum actuator 4*a***. By adjusting the opening degree of the valve, idle speed of the engine is controlled.

Figure 3:
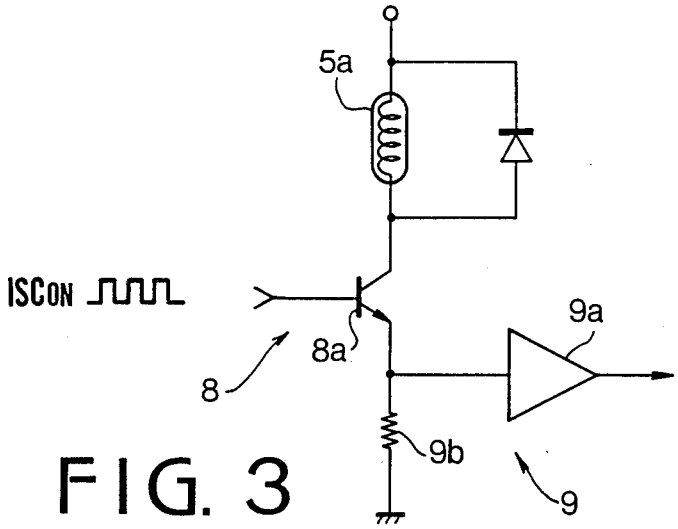
FIG. 3 is a circuit for detecting the temperature of a solenoid of an idle speed control valve.

The actuator **4*a* is operated by vacuum supplied from the intake passage 1 at downstream of the throttle valve 2 through a solenoid operated vacuum control valve 5 having a solenoid 5*a*. The solenoid 5*a* is electrically connected to a driver 8. The driver 8 has a transistor 8*a* as shown in FIG. 3, and is operated by driving pulses supplied from a control unit 10 to excite intermittently the solenoid 5*a*. The control system is further provided with a coolant temperature sensor 6 for detecting the coolant temperature, a crank angle sensor 7 for detecting the engine speed Ne, a solenoid temperature detecting means 9 for detecting the temperature of the solenoid 5*a*, an ignition switch 23 and a throttle switch 24**.

As shown in FIG. 3, the solenoid temperature detecting means 9 comprises a resistor **9*b* connected between the emitter of the transistor 8*a* and the ground, and an amplifier 9*a* for amplifying the voltage at the emitter. Thus, the temperature of the solenoid 5*a*** is represented by the voltage at the emitter.

Figure 2:
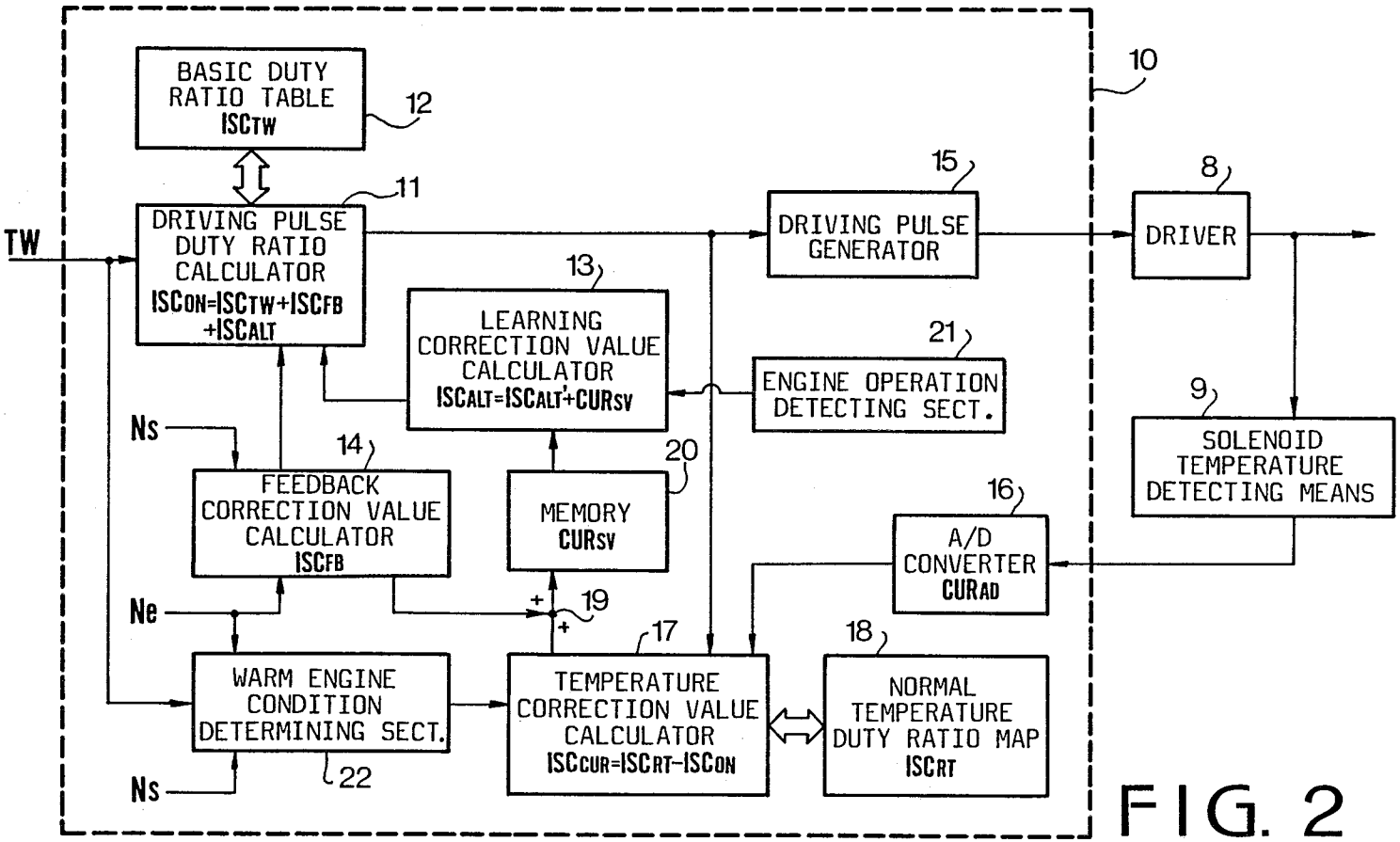
FIG. 2 is a block diagram of a control unit used in a system of the present invention.

Referring to FIG. 2, the control unit 10 has a driving pulse duty ratio calculator 11 which is supplied with a coolant temperature signal TW from the coolant temperature sensor 6 and with a feedback correction value ISCFB from a feedback correction value calculator 14 the operation of which will be described hereinafter. In accordance with the temperature signal TW, the calculator 11 derives a basic duty ratio ISCTW from a basic duty ratio table 12. The calculator 11 operates to add up the basic duty ratio ISCTW, feedback correction value ISCFB and a learning correction value ISCALT stored in a learning correction value calculator 13 to produce a driving pulse duty ratio ISCON. The duty ratio is applied to a driving pulse generator 15. The pulse generator 15 produces a driving pulse train having the duty ratio ISCON which is applied to the base of the transistor 8*a* (FIG. 3) of the driver 8. Thus, the solenoid 5*a* is intermittently excited at the duty ratio.

On the other hand, the voltage at the emitter of the transistor 8*a* obtained by solenoid temperature detecting means 9 is converted to a temperature digital signal CURAD by an A/D converter 16.

Figure 4:
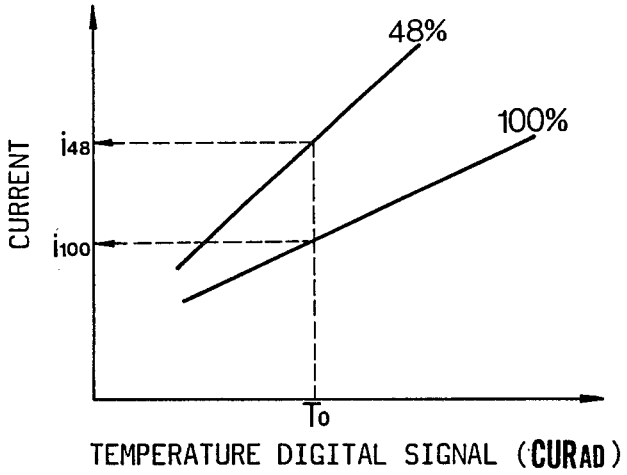
FIG. 4 is a graph showing a relationship between current in the solenoid and detected voltage representing the temperature of the solenoid.

FIG. 4 shows a relationship between the current passing in the solenoid 5*a* and temperature digital signal CURAD. This figure illustrates two examples of the duty ratio ISCON.

Figure 6:
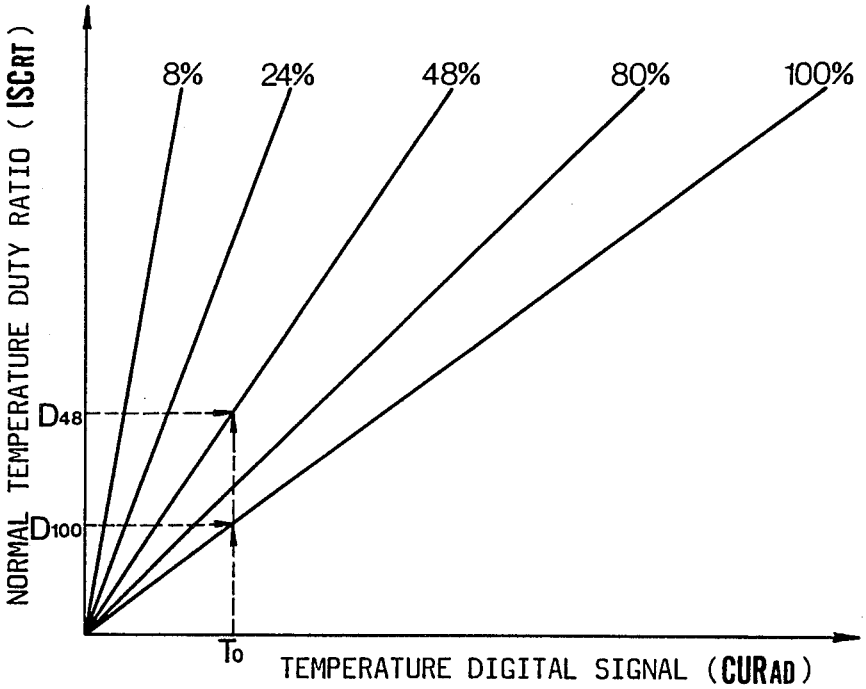
FIG. 6 is a map for deriving a normal temperature duty ratio.
Figure 5:
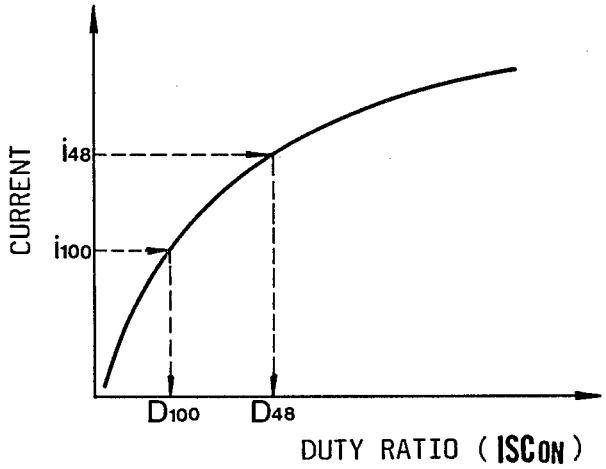
FIG. 5 is a graph showing a relationship between the current and duty ratio for the solenoid at a normal temperature (25° C.)

FIG. 5 shows a relationship between the current in the solenoid and the duty ratio ISCON of the driving pulse at a normal temperature (25° C.) of the control valve 5. From both graphs of FIGS. 4 and 5, a map for deriving a duty ratio at the normal temperature in dependence on the temperature digital signal CURAD and driving pulse duty ratio ISCON can be formed, as shown in FIG. 6. Accordingly, the system is provided with a normal temperature duty ratio map 18 corresponding to the graph of FIG. 6.

The system further has a warm engine condition determining section 22 which produces a warm engine signal when the coolant temperature is higher than a predetermined temperature (62° C.) and when the difference between idle speed Ne and a desired idle speed is smaller than a predetermined value (75 rpm) and continues more than two seconds. This means that the engine speed is decreased since the engine has been warmed up. In accordance with the warm engine signal, a temperature correction value calculator 17 derives a duty ratio ISCRT at the normal temperature from the normal temperature duty ratio map 18, based on the temperature digital signal CURAD from the A/D converter 16 and on the driving pulse duty ratio ISCON from the calculator 11. Namely, the duty ratio ISCRT is a correcting value for converting the driving pulse duty ratio ISCON at a warm engine temperature to a duty ratio at the normal temperature (25° C.). The calculator 17 calculates a temperature correction value ISCCUR by subtracting the driving pulse duty ratio ISCON from the duty ratio ISCRT (ISCCUR=ISCRT−ISCON).

On the other hand, the feedback correction value calculator 14 produces the feedback correction value ISCFB which is the difference between the desired idle speed Ns and actual engine speed Ne. The feedback correction value ISCFB is added to the temperature correction value ISCCUR at an adder 19. The sum of the addition is stored in a memory 20 as a final correction value CURSV.

When the ignition switch 23 is turned off to stop the engine, an engine operation detecting section 21 produces an engine stop signal. In response to the engine stop signal, the learning correction value calculator 13 operates to add the final correction value CURSV to the learning correction value ISCALT' which is obtained at the off of the ignition switch in the last engine operation. The su of the addition is stored as a new learning correction value ISCALT which is used at the subsequent engine operation.

Figure 7:
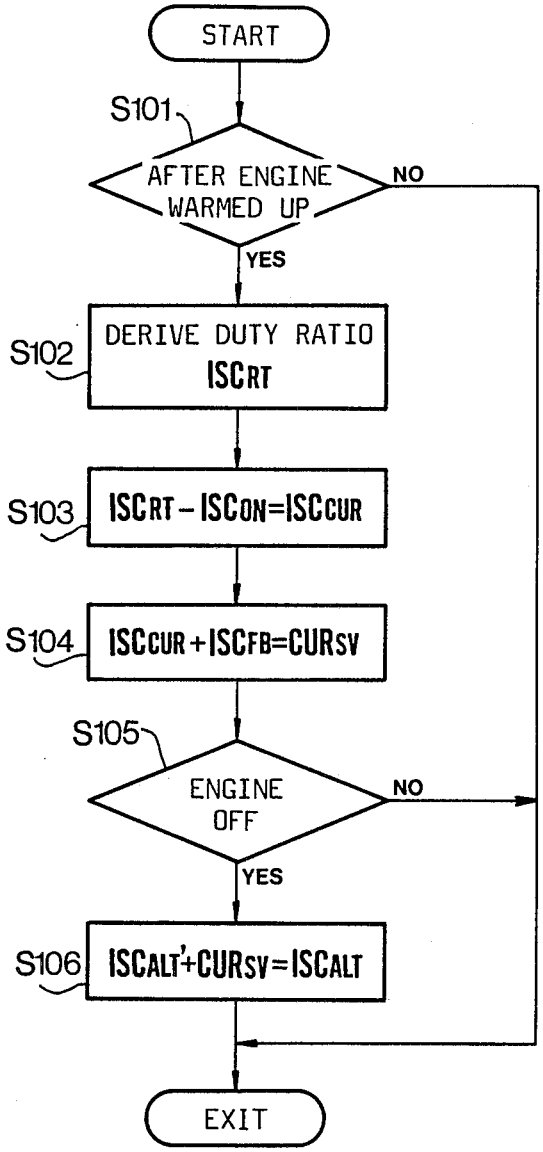
FIG. 7 is a flowchart showing the operation of the system.

The operation of the system is described hereinafter with reference to FIG. 7. At a step S101, it is determined by the section 22 whether the engine is warmed up. After the engine has been warmed up, the program proceeds to a step S102, where the normal temperature duty ratio ISCRT is derived from the map 18 by the calculator 17 in accordance with the driving pulse duty ratio ISCON from the calculator 11 and temperature digital signal CURAD from the A/D converter 16. At a step S103, the normal temperature correction value ISCCUR is calculated by the calculator in accordance with the calculation ISCCUR=ISCRT−ISCON.

Thereafter, at a step S104, the feedback correction value ISCFB dependent on the difference between the desired idle speed Ns and actual idle speed Ne is added to the normal temperature correction value ISCCUR at adder 19 to make the final correction value CURSV which is stored in the memory 20. At a step S105, it is determined whether the ignition switch is turned off. If the switch is off, the program proceeds to a step S106, where the calculator 13 operates to add the final correction value CURSV to the old learning correction value ISCALT' at the last engine operation to make the new learning correction value ISCALT. The old value ISCALT' in the memory is rewritten with the new value ISCALT which is used for the subsequent engine operation. If the ignition switch is not off, the old learning correction value is not rewritten.

From the foregoing it will be understood that the present invention provides an idle speed control system which operates to prevent high idle speed at the subsequent engine operation.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A system for controlling idle speed of an engine having a bypass around a throttle valve and a solenoid operated idle speed control valve provided in the bypass, comprising:

first means for generating driving pulses for driving the idle speed control valve in dependence on a coolant temperature and an old learning correction value;

second means for converting temperature of a solenoid of the control valve to voltage;

a map storing normal temperature duty ratios;

third means for deriving a normal temperature duty ratio from the map in dependence on duty ratio of the driving pulses and the voltage;

a first calculator for producing a difference between the duty ratio of the driving pulses and the derived normal temperature duty ratio;

a memory storing the difference as a correction value;

detecting means for detecting turning off of an ignition switch and for producing an off signal;

a second calculator responsive to the off signal for adding the correction value to the old learning correction value to produce a new learning correction value and for storing the new learning correction value for a subsequent engine operation instead of the old learning correction value.

2. The system according to claim 1 further comprising fourth means for producing a feedback correction signal from a difference between an actual idle speed and a desired idle speed, and a fifth means for adding the feedback correction signal to the correction value to produce a final correction value which is used for producing a new learning correction value.

* * * * *